US005683239A

United States Patent [19]

Cardosi

[11] Patent Number: 5,683,239

[45] Date of Patent: Nov. 4, 1997

[54] CANDLE HOLDER

[75] Inventor: Leo Cardosi, Aiken, S.C.

[73] Assignee: Gorham Bronze, Aiken, S.C.

[21] Appl. No.: 414,287

[22] Filed: Mar. 31, 1995

[51] Int. Cl.[6] ..... F23D 3/16; F21L 19/00

[52] U.S. Cl. ..... 431/291; 431/296; 362/180; 362/163

[58] Field of Search ..... 431/296, 291; 362/161, 162, 163, 180, 313, 314, 315, 174, 175, 176, 177, 178, 179

[56] References Cited

U.S. PATENT DOCUMENTS

| | | | |
|---|---|---|---|
| 148,964 | 3/1874 | Langston | 362/180 |
| 149,768 | 4/1874 | Marcy | 362/180 |
| 206,917 | 8/1878 | Atwood | 362/180 |
| D. 258,389 | 2/1981 | Sabin | D26/22 |
| D. 262,913 | 2/1982 | Glass | D26/13 |
| D. 264,385 | 5/1982 | Meyer | D26/9 |
| D. 271,056 | 10/1983 | Perkins | D26/11 |
| D. 279,129 | 6/1985 | Wendt | D26/9 |
| D. 285,159 | 8/1986 | Wexler | D7/83 |
| D. 286,845 | 11/1986 | Jones | D7/52 |
| D. 289,799 | 5/1987 | Flaherty | D26/9 |
| D. 296,138 | 6/1988 | Cheng | D26/10 |
| D. 298,859 | 12/1988 | Crisci | D26/10 |
| D. 302,318 | 7/1989 | O'Donnell | D26/9 |
| D. 312,507 | 11/1990 | Thoreson | D26/23 |
| D. 312,883 | 12/1990 | O'Donnell | D26/20 |
| D. 313,479 | 1/1991 | Goldberg | D26/16 |
| D. 321,566 | 11/1991 | Hoelterscheidt | D26/9 |
| D. 325,446 | 4/1992 | Collymore | D26/13 |
| D. 328,446 | 8/1992 | Wokeck | D26/9 |
| D. 330,345 | 10/1992 | Elmer | D11/125 |
| D. 336,526 | 6/1993 | Marienberg | D26/11 |
| D. 340,297 | 10/1993 | Hanson | D26/9 |
| 370,770 | 10/1887 | Drumbeller | 362/163 |
| 846,115 | 3/1907 | Leland et al. | 362/176 |
| 1,549,157 | 8/1925 | Silverman | 362/180 |
| 1,601,677 | 9/1926 | Cesareo | 362/163 |
| 1,646,328 | 10/1927 | Sylvester | 362/180 |
| 2,685,023 | 7/1954 | Valle | 362/163 |
| 3,244,872 | 4/1966 | McCormick | 240/16 |
| 3,368,693 | 2/1968 | Bochory | 211/126 |
| 3,493,315 | 2/1970 | Nissen | 431/295 |
| 3,556,704 | 1/1971 | Grasznick | 431/290 |
| 3,574,498 | 4/1971 | Zarinsky | 431/126 |
| 3,583,853 | 6/1971 | Schramm | 431/291 |
| 3,726,632 | 4/1973 | Connolly | 431/126 |
| 3,743,473 | 7/1973 | Von Suskil | 431/297 |
| 3,819,455 | 6/1974 | MacKendrick | 161/7 |
| 3,932,113 | 1/1976 | Thrush | 431/297 |
| 3,994,502 | 11/1976 | Lombardi | 274/2 |
| 4,181,927 | 1/1980 | Garcia | 362/163 |
| 4,240,783 | 12/1980 | Nevin et al. | 431/253 |
| 4,262,325 | 4/1981 | Garcia | 431/291 X |
| 4,524,408 | 6/1985 | Minera | 361/163 |
| 4,544,351 | 10/1985 | Marsicano | 431/288 |
| 4,566,055 | 1/1986 | Klees et al. | 362/162 |
| 4,680,683 | 7/1987 | Schenke et al. | 362/190 |
| 4,681,534 | 7/1987 | Schenke et al. | 431/290 |
| 4,721,455 | 1/1988 | Barfus | 431/295 |

(List continued on next page.)

FOREIGN PATENT DOCUMENTS

| | | | |
|---|---|---|---|
| 92752 | 6/1996 | Germany | 362/163 |

*Primary Examiner*—Carl D. Price
*Attorney, Agent, or Firm*—Maria Reichmanis

[57] ABSTRACT

A candle holder having a base with a seat for receiving a candle, a housing, a cover, and spring-loaded connecting means for detachably connecting the housing and the cover to the base. Air passage means formed in the base and the cover allow movement of air into and out of the housing; throughholes formed in the cover direct entering rain away from the candle. The base and cover are preferably made of bronze or some other substantially rust-resistant metal; the housing is made of an optically transparent or translucent material. In a preferred embodiment of the invention, a heat shield is positioned inside the housing to evenly distribute heat from a burning candle and prevent the formation of hot spots. The base may be provided with adapters for attachment to a cemetery marker or insertion into the ground.

20 Claims, 3 Drawing Sheets

U.S. PATENT DOCUMENTS

| | | | |
|---|---|---|---|
| 4,884,966 | 12/1989 | Wexler | 431/295 |
| 4,931,013 | 6/1990 | Scott et al. | 431/126 |
| 4,938,688 | 7/1990 | Wexler | 431/295 |
| 4,955,807 | 9/1990 | Chance et al. | 431/296 |
| 5,055,035 | 10/1991 | Hancovsky | 431/291 X |
| 5,078,945 | 1/1992 | Byron | 264/278 |
| 5,101,328 | 3/1992 | Hai | 362/163 |
| 5,197,454 | 3/1993 | Lee | 126/9 R |
| 5,199,781 | 4/1993 | Sweeny | 362/145 |
| 5,292,245 | 3/1994 | Spoonhour | 431/292 |

CANDLE HOLDER

BACKGROUND OF THE INVENTION

1. Field of the Invention

The present invention relates to candle holders. In particular, the present invention relates to a candle holder having a spring-loaded cover.

2. Discussion of Background

Candles have been used to provide light for most of recorded history. Their historical importance is evidenced by the many terms that depend on candles for imagery: it is "better to light a single candle than curse the darkness"; "to burn a candle at both ends" means to waste; "to hold a candle" to someone is to assist him while he works; "not fit to hold a candle" to another means not equal to that person; "the game is not worth the candle" when it is not worth the cost of supplying candles for light. In literature, candles are sometimes used as metaphors for life itself: "out, out, brief candle, . . . " Standard spermaceti candles were once used to measure units of illuminating power, giving rise to the terms "candela" and "candlepower."

With the advent of other sources of artificial light, use of candles for lighting has lessened. Nowadays, candles are used primarily in religious services, memorial services, as decorative accessories, and to help create an atmosphere (for example, the proverbial dinner by candlelight). Many different types of candles and candle holders are known, including candle sticks, votive candle holders, candelabras, and floating candles, in many different designs.

Candles have been used in religious and memorial services since the middle ages (we speak of "lighting a candle" to honor a saint or in memory of a deceased person). While cremation is becoming increasingly accepted as an alternative to burial, most Western burials take place in conventional cemeteries or the increasingly popular "perpetual care" cemeteries. Instead of the diversity of tombstones found in many older, conventional cemeteries, perpetual care cemeteries have gravesites marked by uniformly-sized metal or stone markers commemorating the deceased. Some markers are sized so that a husband and wife can have both their names inscribed thereon. Frequently, such markers include a vase for holding flowers. Unfortunately, these vases are subject to theft and vandalism if left permanently in place. Therefore, the vases are detachably placed on or near the markers, for example, by means of a spike that can be driven into the ground or a base that can be attached to a marker.

Visiting the grave of a deceased friend or relative on Memorial Day, Veterans Day, and so forth, is an important part of mourning and remembrance for many people. When visiting a grave, friends and family members may wish to contemplate the site for a period of time, in order to remember times they shared with the deceased. Lighting a candle during the visit both honors the deceased and serves as a reminder that life continues.

Many types of candle holder are known, including the designs shown by Hanson (U.S. No. D340,297), Marienberg (U.S. No. D336,526), Wokeck (U.S. No. D328,356), Collymore (U.S. No. D325,446), Goldberg (U.S. No. D313,479), O'Donnell (U.S. No. D312,883), Thoreson (U.S. No. D312,507), O'Donnell (U.S. No. D302,318), Hoelterscheidt (U.S. No. D231,566), Wendt (U.S. No. D279,129), Perkins (U.S. No. D271,056), Wendt (U.S. No. D279,129), Meyer (U.S. No. D264,385), Glass (U.S. No. D262,913), and Sabin (U.S. No. D258,389).

Candle holders may include items such as containers (Cheng, U.S. No. D296,138; Nevin, et at., U.S. Pat. No. 4,240,783), condiment stands (Jones, U.S. No. D286,845), cake covers (Crisci, U.S. No. D298,859; Wexler, U.S. Pat. Nos. 4,938,688, 4,884,966, 285,159; Barfus, U.S. Pat. No. 4,721,455; MacKendrick, U.S. Pat. No. 3,819,455), table mobiles (Elmer, U.S. No. D330,345), molds for forming a new candle from molten wax (Byron, U.S. Pat. No. 5,078,945), altars (Garcia, U.S. Pat. No. 4,262,325), cigarette lighters (Nevin, et al., U.S. Pat. No. 4,240,783), turntables for playing sound recordings (Lombardi, U.S. Pat. No. 3,994,502), flower holders (Zarinsky, U.S. Pat. No. 3,574,498), trays (Bochory, U.S. Pat. No. 3,368,693), brandy glasses (Draper, et at., U.S. Pat. No. 4,566,055), and jack-o-lanterns (McCormick, U.S. Pat. No. 3,244,872).

While many candle holders are designed to be held by the user (for example, Spoonhour, U.S. Pat. No. 5,292,245), others support candles for viewing through a window (Sweeny, U.S. Pat. No. 5,199,781; Flaherty, U.S. No. D289,799), mounted to the neck of a bottle (Connolly, U.S. Pat. No. 3,726,632), or floating on a pool of water (Hai, U.S. Pat. No. 5,101,328; Minera, U.S. Pat. No. 4,524,408). Some holders are adjustable to hold candles of different sizes (Thrush, U.S. Pat. No. 3,932,113; Grasznick, U.S. Pat. No. 3,556,704; Nissen, U.S. Pat. No. 3,493,315). Schenke, et al. (U.S. Pat. No. 4,680,683) describe a device for converting a candle holder into an electrically actuated simulated candle.

Features such as bowls for holding fragrance (Lee, U.S. Pat. No. 5,1979,454), covers (Garcia, U.S. Pat. No. 4,181,927), spiral coils for anchoring a candle to a substrate (Chance, et al., U.S. Pat. No. 4,955,807), drip pans (Thrush, U.S. Pat. No. 3,932,113), drain holes (Schenke, et al., U.S. Pat. No. 4,681,534), heat shields (Draper, et al., U.S. Pat. No. 4,566,055), and convertible holders (Von Suskil, U.S. No. 3,743,473) are also known.

Candle holders may be made of a wide range of materials, including plastic (Spoonhour, U.S. Pat. No. 5,292,245; Wexler, U.S. Pat. No. 4,884,966; Schramm, U.S. Pat. No. 3,583,853), beveled glass (Scott, et al., U.S. Pat. No. 4,931,014), metal (Draper, et al., U.S. Pat. No. 4,566,055), and paper (Marsicano, U.S. Pat. No. 4,544,351).

Despite the wide variety of available candle holders, there is a need for a stable, durable candle holder for memorial use which holds a candle securely, which protects the candle from wind and rain, which may be easily opened for replacing the candle when needed, and which may be secured in place at a gravesite for as long as needed.

SUMMARY OF THE INVENTION

According to its major aspects and broadly stated, the present invention is a candle holder having a base with a seat for receiving a candle, an optically transparent or translucent housing, a cover, and spring-loaded connecting means for detachably connecting the housing and the cover to the base. Air passage means formed in the base and the cover allows movement of air into and out of the housing; throughholes formed in the cover direct entering rain away from the candle. The base and cover are preferably made of bronze or some other substantially rust-resistant metal; the housing is made of an optically transparent or translucent material. In a preferred embodiment of the invention, a heat shield is positioned inside the housing to evenly distribute heat from a burning candle and prevent formation of "hot spots." The base may be provided with adapters for attachment to a cemetery marker or insertion into the ground.

An important feature of the present invention is the spring-loaded connecting means. The connecting means secures the housing and the cover in position, but can be readily disassembled to allow the user to light or extinguish a candle, or to replace a spent candle.

Another important feature of the present invention is the heat shield, which distributes the heat from a burning candle evenly over the material of the housing to prevent formation of hot spots. The heat shield has a plurality of holes formed therethrough to allow viewers to enjoy the light of a burning candle.

Another feature of the present invention is the base, which may include adapters that allow the user to place the candle holder on an approximately flat surface, attach the holder to a cemetery marker, or fix it to the ground.

Still another feature of the present invention is the throughholes formed in the cover, which serve as air passages. The throughholes are approximately perpendicular to the base of the candle holder, and are positioned so that any rain that enters the housing is directed towards the sides of the housing and away from the candle.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
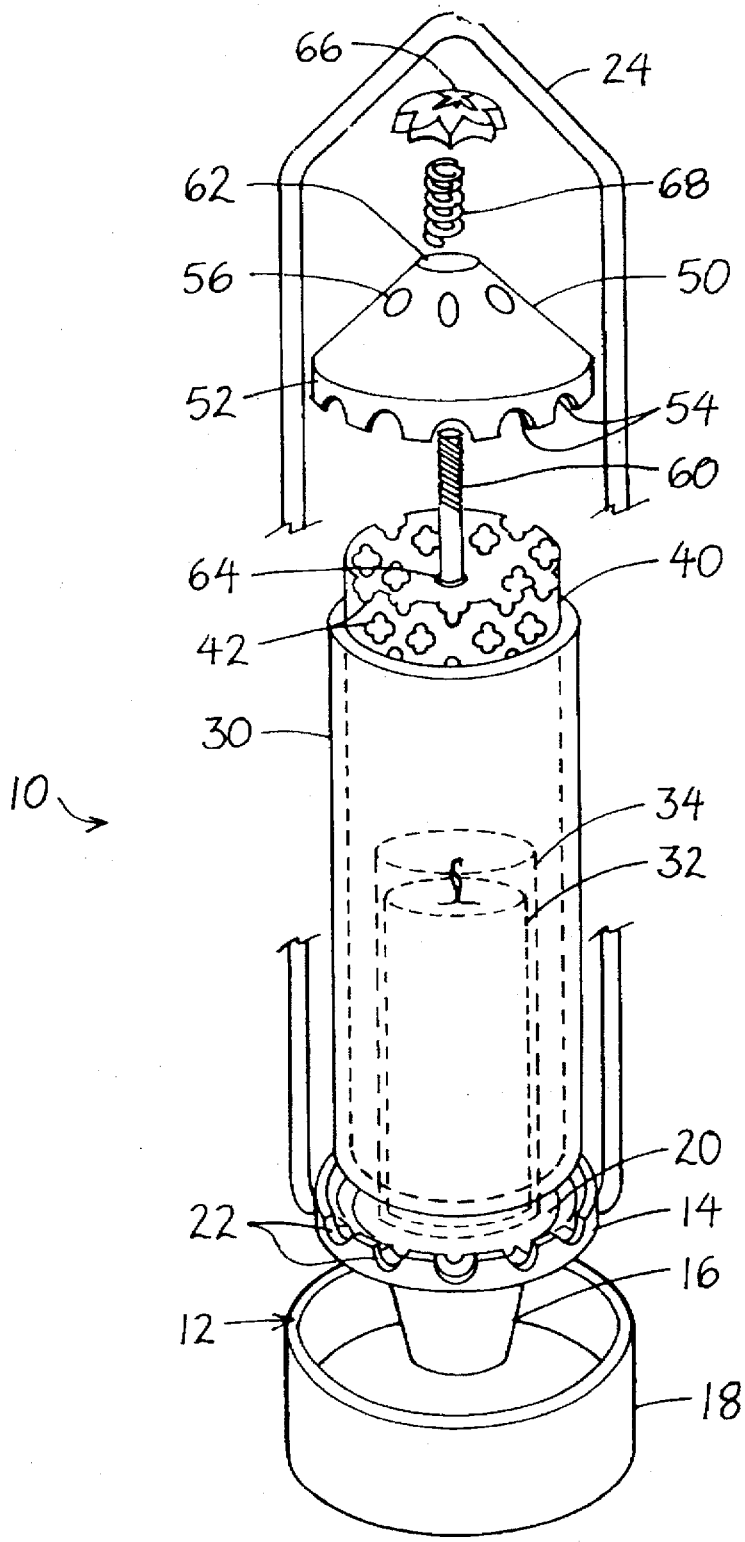
FIG. 1 is a partially exploded, perspective view of a candle holder according to a preferred embodiment of the present invention.

In the following description, like reference numerals are intended to identify the same structural elements, portions or surfaces consistently throughout the several drawing figures, as such elements, portions or surfaces may be further described or explained by the entire written specification.

Figure 2:
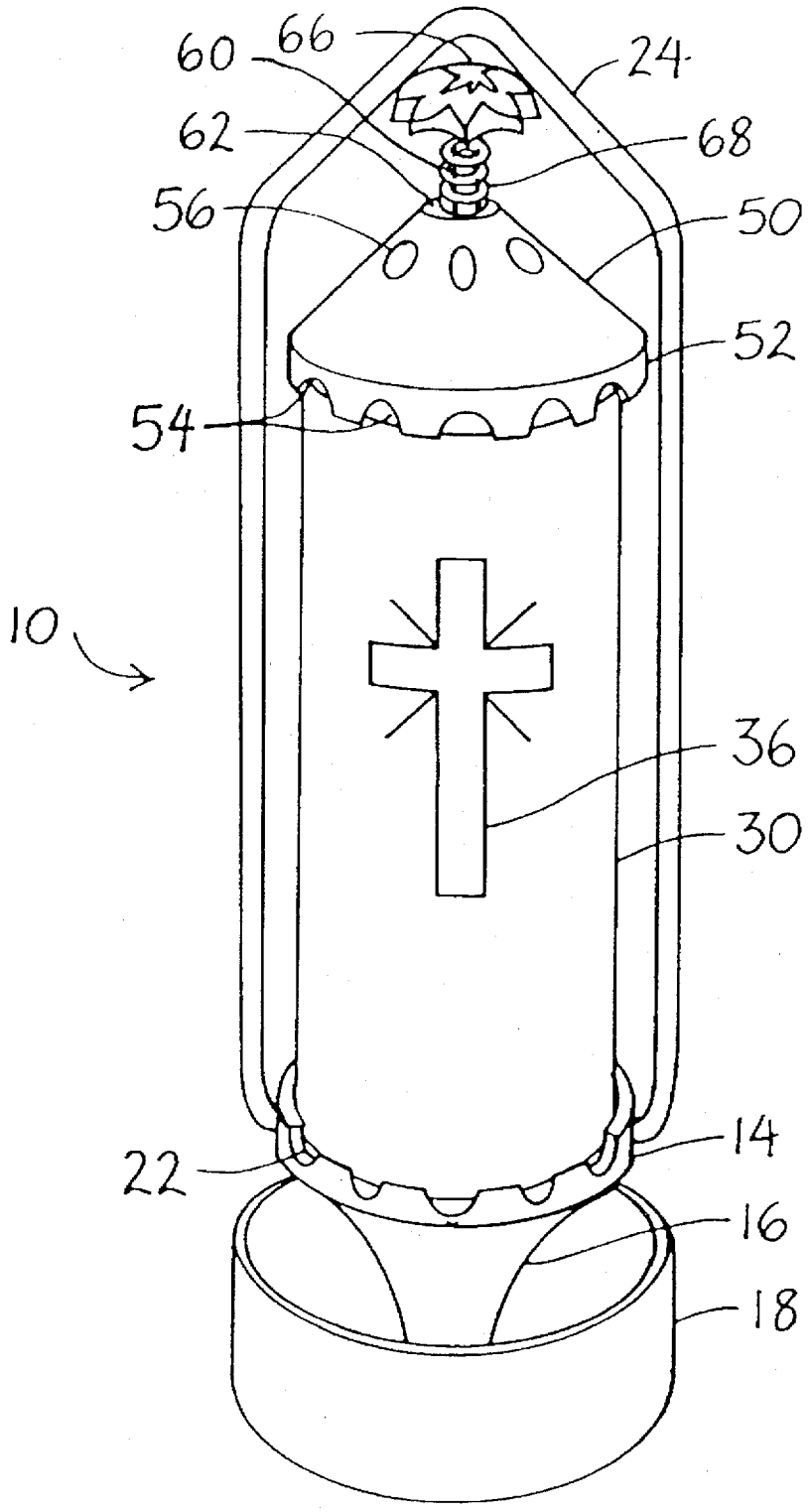
FIG. 2 is a front view of the candle holder of FIG. 1.

Referring now to FIGS. 1 and 2, there is shown a partially exploded, perspective view of a candle holder according to a preferred embodiment of the present invention. A candle holder 10 includes abase 12 with an upwardly extending flange 14, a neck portion 16, a lower portion 18 and a seat 20. Flange 20 has a plurality of grooves or channels 22 formed therethrough, preferably approximately equally spaced about the circumference of flange 20. Grooves 22 may be arcuate as shown in FIG. 1, or some other shape if desired. A retainer or handle 24 is pivotably attached to base 12. If desired, retainer 24 may be attached to some other part of base 12, such as neck 16 or lower portion 18. Base 12 is preferably circular in cross section as shown, but may be square, octagonal, or some other shape without departing from the spirit of the present invention.

A housing 30 rests on seat 20 of base 12. Housing 30 is made of some optically transparent or translucent material such as glass or plastic (LEXAN, PLEXIGLAS, or the like), of any desired color, and may have one or more designs such as design 36 thereon (see FIG. 2). Designs 36, if present, are formed by etching, engraving, stamping, or some other convenient means. If desired, designs 36 may be decals or foil cutouts affixed to housing 30. A candle 32 rests on seat 20 inside housing 30. Candle 32 may be a free-standing candle with a wick, or a votive candle placed inside an optically transparent container 34. If holder 10 is intended for use with free-standing candles, seat 20 may include an upwardly extending spike (not shown) or other suitable means for securing candle 32 in place.

A heat shield 40 is positioned inside housing 30, preferably engaging the inner surface of the housing. When candle 32 is lit, heat shield 40 absorbs heat from the burning candle and distributes the heat evenly over the inner surface of housing 30, thereby preventing formation of hot spots. In order that viewers may enjoy the light of candle 32, heat shield 40 has a plurality of holes 42 formed therethrough. Holes 42 may be of any desired shape, and be arranged in any desired pattern to enhance the esthetic effect of a lit candle 32 to the viewer.

Heat shield 40 may be attached to housing 30 or simply press-fitted into place. In a preferred embodiment of the present invention, heat shield 40 is made of a substantially rust-resistant metal such as brass, bronze, aluminum or stainless steel, although other metals may be used if convenient.

Housing 30 is covered by a cover 50. Cover 50 has a downwardly extending flange 52 with a plurality of spaced-apart channels 54. Channels 54 may be approximately arcuate and have approximately the same dimensions as channels 22 of base 12, or be some other size and shape if preferred. Preferably, cover 50 has a plurality of throughholes 56 formed therethrough. Throughholes 56 are approximately perpendicular to base 12 (that is, parallel to housing 30), as shown in FIG. 1.

Figure 3:
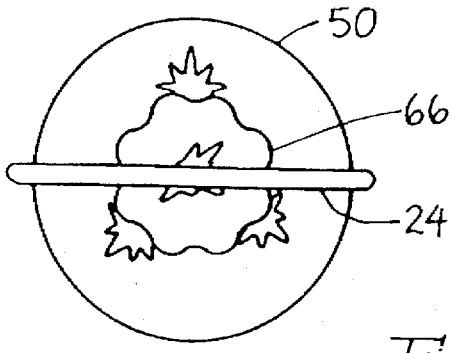
FIG. 3 is a top view of the candle holder of FIG. 1.

A movable rod 60 extends through a hole 62 in cover 50. Rod 60 has a first end terminating in a stop 64, and an opposing, threaded end screwed into a button 66 (FIGS. 1, 3). A spring 66 is disposed about rod 60. When candle holder 10 is assembled, spring 66 is compressed and exerts a force against cover 50 and retainer 24, so that retainer 24 is in an approximately vertical position to hold cover 50 and housing 30 in place on base 12.

To disassemble candle holder 10, the user depresses button 66, thereby compressing spring 66 and moving rod 60 downwards, and pivots retainer 24 away from the button. Cover 50 and housing 30 can then be easily removed in order to light candle 32 or replace a spent candle with a fresh candle. It will be evident to those skilled in the art that holder 10 may be used with other types of lights in addition to candles, including but not limited to oil lamps, kerosene lamps, and battery-operated electric lights.

Figure 4:
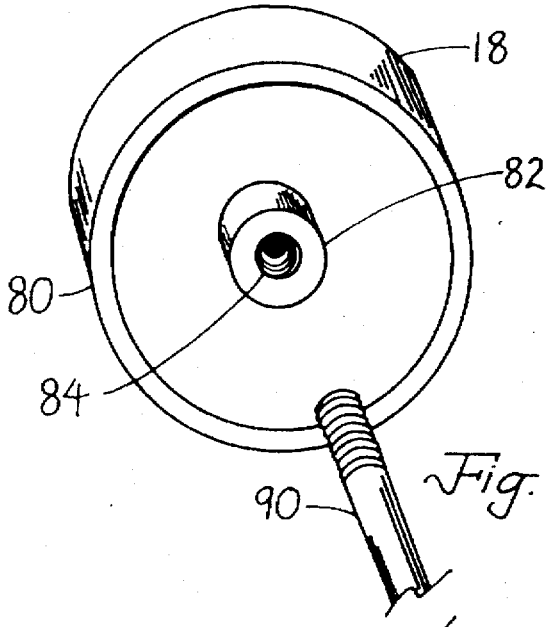
FIG. 4 is a bottom perspective view of the candle holder of FIG. 1.
Figure 5:
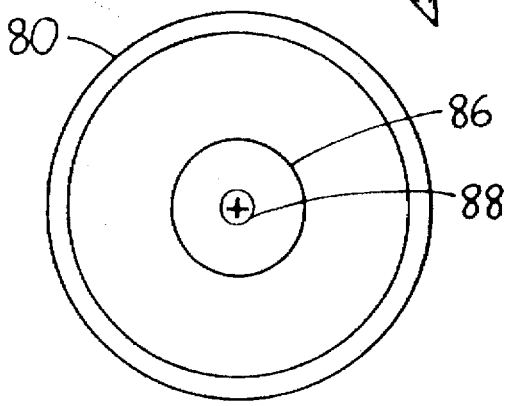
FIG. 5 is a bottom view of a candle holder according to another preferred embodiment of the present invention.

A bottom view of base 12, in one embodiment of the present invention, is shown in FIG. 4. In the embodiment shown in FIG. 4, base 12 has a downwardly-extending flange 80 and a threaded hole 82. Thus, candle holder 10 may rest on base 12 when placed upright on any suitable surface. Alternatively, a threaded spike 90 may be screwed into hole 82. When present, spike 90 may be inserted into the ground to retain candle holder 10 in an approximately upright position. In another embodiment of the invention, an adapter 86 is attached to base 12 by a screw or other fastening means 88 (FIG. 5). Adapter 86 allows the user to set base 12 onto a matching holder on a memorial plaque or other stand (not shown). To enhance the versatility of candle holder 10, hole 82 is preferably threaded so as to accept either screw 88 or spike 90.

In use, candle 32 (including container 34 if desired) is placed on seat 20. Housing 30 is placed on base 12 about candle 32, capped by cover 50 held in place by retainer 24. The user may carry candle holder 10, set the holder onto a surface such as a cemetery marker or the ground, or insert spike 90 into the ground to retain holder 10 in position. When candle 32 is lit, housing 30 and cover 50 act as a wind shield to prevent the candle from being flickering or being extinguished by moving air currents. Heat shield 40 distributes heat from the burning candle evenly across the body of housing 30, thereby preventing the formation of hot spots and helping keep heat contained inside housing 30 so that wax is melted evenly across the surface of candle 32. Throughholes 42 in shield 40 also create a pleasing light pattern for the viewer. Channels 22 and 54, and throughholes 56, provide air passages for air to pass into and out of housing 30. In addition, throughholes 56 deflect entering rain away from candle 32. Thus, a lit candle in holder 10 may be left outdoors for extended periods of time even in inclement weather.

Housing 30 may have any desired shape, including cylindrical, rectangular, hexagonal, octagonal and other cross-sections. However, for ease of manufacturing candle holder 10, housings with an approximately circular cross section (as shown in FIGS. 1–5) are preferred. As will now be evident, the other components of candle holder 10 may also have different shapes. For example, base 12 may be a formed as a cylinder, pedestal, obelisk, and so forth. Channels 22 and 54 may be of any desired shape. Flanges 14 and 52 may be approximately perpendicular to seat 20 as shown in FIG. 1, or be inwardly or outwardly flared if desired.

It will be apparent to those skilled in the art that many changes and substitutions can be made to the preferred embodiment herein described without departing from the spirit and scope of the present invention as defined by the appended claims.

What is claimed is:

1. A candle holder, comprising:

a base having a seat formed thereon for receiving a candle;

a housing having an open upper end and an open lower end;

a cover having a central throughhole; and spring-loaded means attached to said base for detachably connecting said housing, said cover, and said base so that said lower end engages said seat and said upper end engages said cover, said connecting means including a retainer pivotably attached to said base;

a rod having a first end and a second end, said rod passing through said throughhole;

a first stop attached to said first end of said rod;

a second stop attached to said second end of said rod;

a spring disposed about said rod between said first stop and said cover so that, when said retainer is pivoted to an approximately perpendicular position with respect to said base, said spring exerts an upward thrust on said first stop and said retainer to retain said housing and said cover on said base.

2. The candle holder as recited in claim 1, wherein said base has first air passage means formed therein.

3. The candle holder as recited in claim 1, wherein said cover has second air passage means formed therein.

4. The candle holder as recited in claim 1, wherein said housing is made of an optically transparent or translucent material.

5. The candle holder as recited in claim 1, wherein said base and said cover are made of a substantially rust-resistant metal.

6. The candle holder as recited in claim 1, wherein said cover slopes with respect to said base, and wherein said cover has a plurality of throughholes formed therethrough, said throughholes being approximately perpendicular to said base.

7. The candle holder as recited in claim 1, wherein said base and said cover are made of bronze.

8. A candle holder, comprising:

a base having a seat formed thereon for receiving a candle;

a housing having an open upper end, an open lower end, an inner surface, and an outer surface;

a heat shield engaging said inner surface of said housing;

a cover having a central throughhole; and spring-loaded means attached to said base for detachably connecting said housing, said cover, and said base so that said lower end engages said seat and said upper end engages said cover, said connecting means including a retainer pivotably attached to said base;

a rod having a first end and a second end, said rod passing through said throughhole;

a first stop attached to said first end of said rod;

a second stop attached to said second end of said rod;

a spring disposed about said rod between said first stop and said cover so that, when said retainer is pivoted to an approximately perpendicular position with respect to said base, said spring exerts an upward thrust on said first stop and said retainer to retain said housing and said cover on said base.

9. The candle holder as recited in claim 8, wherein said base has first air passage means formed therein.

10. The candle holder as recited in claim 8, wherein said cover has second air passage means formed therein.

11. The candle holder as recited in claim 8, wherein said housing is made of a material selected from the group consisting of optically transparent materials and optically translucent materials.

12. The candle holder as recited in claim 8, wherein said housing is made of a material selected from the group consisting of glass and plastic.

13. The candle holder as recited in claim 8, wherein said base and said cover are made of bronze.

14. The candle holder as recited in claim 8, wherein said heat shield is made of metal, and wherein said heat shield has a plurality of throughholes formed therein.

15. A candle holder, comprising:

a base having a seat formed thereon for receiving a candle, said base having an upwardly extending flange, said upwardly extending flange having air passage means formed therein;

a housing having an open upper end, an open lower end, an inner surface, and an outer surface, said housing made of an optically transparent or optically translucent material;

a heat shield engaging said inner surface of said housing;

a cover having a central throughhole and a downwardly extending flange, said downwardly extending flange having air passage means formed therein;

a retainer pivotably attached to said base;

a rod having a first end and a second end, said rod passing through said throughhole;

a first stop attached to said first end of said rod;

a second stop attached to said second end of said rod; and a spring disposed about said rod between said first stop and said cover so that, when said retainer is pivoted to an approximately perpendicular position with respect to said base, said spring exerts an upward thrust on said first stop and said retainer to retain said housing and said cover on said base.

16. The candle holder as recited in claim 15, wherein said cover has a plurality of substantially vertical throughholes formed therein, said throughholes positioned to direct water passing therethrough away from said candle.

17. The candle holder as recited in claim 15, wherein said base and said cover are made of bronze.

18. The candle holder as recited in claim 15, further comprising means attached to said base for attaching said base to a substrate.

19. The candle holder as recited in claim 15, wherein said base has an upper surface and a lower surface, further comprising a downwardly extending spike removably attached to said bottom surface of said base.

20. The candle holder as recited in claim 15, wherein said housing is made of a material selected from the group consisting of glass and plastic.

* * * * *